US008608598B2

(12) United States Patent
Hoang

(10) Patent No.: US 8,608,598 B2
(45) Date of Patent: Dec. 17, 2013

(54) BOOMERANG

(75) Inventor: Ho Vinh Hoang, Dong Da district (VN)

(73) Assignee: Tosy Robotics Joint Stock Company, Hanoi (VN)

( * ) Notice: Subject to any disclaimer, the term of this patent is extended or adjusted under 35 U.S.C. 154(b) by 244 days.

(21) Appl. No.: 12/681,817

(22) PCT Filed: Oct. 9, 2008

(86) PCT No.: PCT/VN2008/000004
§ 371 (c)(1),
(2), (4) Date: Apr. 6, 2010

(87) PCT Pub. No.: WO2009/049329
PCT Pub. Date: Apr. 16, 2009

(65) Prior Publication Data

US 2010/0240478 A1 Sep. 23, 2010

(30) Foreign Application Priority Data

Oct. 12, 2007 (VN) ..... 1-2007-02103

(51) Int. Cl.
*A63F 3/00* (2006.01)

(52) U.S. Cl.
USPC ..... 473/590; 446/46

(58) Field of Classification Search
USPC ..... 473/590; 446/34, 36, 46, 48, 61
See application file for complete search history.

(56) References Cited

U.S. PATENT DOCUMENTS 2,640,296 A * 6/1953 Johnson et al. ..... 446/40
2,688,206 A * 9/1954 Nagler ..... 446/40
3,082,572 A * 3/1963 Knox, Jr. ..... 446/46
3,507,461 A * 4/1970 Rosta ..... 244/17.23
3,603,033 A * 9/1971 Mueller ..... 446/57

(Continued)

FOREIGN PATENT DOCUMENTS

BE 496126 10/1950
CN 101820961 9/2010

(Continued)

OTHER PUBLICATIONS

International Search Report for PCT/VN2008/000004, Mar. 26, 2009.

(Continued)

*Primary Examiner* — Vishu K. Mendiratta
(74) *Attorney, Agent, or Firm* — Foley & Lardner LLP

(57) ABSTRACT

The invention relates to a boomerang that can automatically change both elevation angle α of blades and curve radius r of blades upon the change of rotary speed of blades (12), wherein blades (12) are made of elastically plastic film preferably selected from a group of polyvinyl chloride, polypropylene, polyethylene terephthalate, polystyrene and high impact polystyrene, the material has a specific weight of from about 0.9 g/cm$^3$ to about 1.60 g/cm$^3$ and as thickness from about 0.1 mm to about 1 mm; the ratio between the depth of the rear groove and blade width is from about 1/7 to about 6/7; the ratio between depth of the front groove and blade width is from about 0 to about 3/7; the elevation angle α0 is from about 10° to about 45°; the initial curve radius $r_0$ of the blades is longer or equal to 1/5 of the radius R of said ring (13); the ratio between the total area of said blades and the area of a circle defined by said ring (13) is from about % to about 38%.

18 Claims, 5 Drawing Sheets

(56) References Cited

U.S. PATENT DOCUMENTS

| | | | | |
|---|---|---|---|---|
| 3,608,976 | A * | 9/1971 | Zugelder et al. | 406/97 |
| 4,135,718 | A * | 1/1979 | Loewy et al. | 273/409 |
| 5,030,157 | A * | 7/1991 | Silverglate | 446/48 |
| 7,255,623 | B2 * | 8/2007 | Davis | 446/36 |
| 2002/0098768 | A1 * | 7/2002 | Kuo et al. | 446/39 |
| 2007/0031253 | A1 | 2/2007 | Muren | |
| 2008/0153381 | A1 * | 6/2008 | Schenk et al. | 446/40 |

FOREIGN PATENT DOCUMENTS

| | | |
|---|---|---|
| DE | 201 03 046 | 6/2001 |
| DE | 2020050 04 207 | 11/2005 |
| EP | 2 219 752 | 8/2010 |
| FR | 388813 | 8/1908 |
| JP | 05-228265 | 9/1993 |
| JP | 2005152090 | 6/2005 |
| JP | 2005-242388 | 9/2005 |
| JP | 2011-500176 | 1/2011 |
| KR | 20297767 | 11/2002 |
| KR | 1020039554 | 1/2003 |
| KR | 10200688331 | 8/2006 |
| KR | 20100085098 | 7/2010 |
| KR | 10-1054275 | 7/2011 |
| WO | WO-2009/049329 | 4/2009 |

OTHER PUBLICATIONS

Extended European Search Report for EP Application No. 08 837 414.5, dated Nov. 18, 2011, 7 pages.

International Search Report and Written Opinion for PCT Application No. PCT/VN2008/000004, mailed Mar. 26, 2009, 5 pages.

* cited by examiner a. No movement b. Movement at low speed c. Movement at high speed

BOOMERANG

This patent application is a nation stage application under 35 U.S.C. §371 of international application PCT/VN2008/000004, filed on Oct. 9, 2008, which claims priority to Vietnamese patent application number 1-2007-02103, filed on Oct. 12, 2007, the entire contents of which are hereby incorporated by reference in their entireties.

TECHNICAL FIELD

The present invention relates to a boomerang having a round ring with blades inside that can fly by means of a launching force and then can fly back to its launching position. More specifically, this invention relates to a boomerang that can automatically change both the elevation angle of the blades and the curve radius of the blades upon the change of rotary speed of the blades thanks to a special construction shape of the blades as well as the material of which the blades are made.

BACKGROUND ART

There have been many flying toys having rotor which can fly by means of receiving a rotary movement that makes the rotor spin around its center. Such a flying toy has been disclosed in U.S. patent application No. US2002098768 A1 (published on Jul. 25, 2002, inventors: KUO YIN JYH (TW); YANG HSIN-HAO (TW)). Since the rotor of that toy has its blades with fixed elevation angle, so when receiving rotary movement generally with a very high angular speed at the beginning caused by a launcher, the rotor will be effected by a very high lift force that rapidly increases the height of said rotor too much. Concurrent with such a high lift force, an air-drag force effecting on the blades of the rotor is high too, that results in decreasing the rotary speed of the rotor. As a result, the lift force rapidly decreases that in turn makes the rotor fall down. That means the flying rotors having blades with fixed elevation angle will have their flying time relatively short that decreases the amusement effect to players. Moreover, since the flying time of such a flying rotor is too short, so the rotor has not time enough for flying back to its launching position, so-called "boomerang effect". That further decreases the amusement effect to players.

To overcome the above said problem, some flying toys have recently been developed in the way of changing an elevation angle of the blades according to their rotary speed: reducing the elevation angle of the rotary blades when the rotary speed is high, and increasing the elevation angle of the rotary blades when the rotary speed is low that keeps a sufficient flying time without increasing a flying height too much. Example of such a flying toy has been disclosed in Japanese patent application No. JP2005152090 (published on Jun. 16, 2005, inventor: Masui Hikari (JP)).

However, these toys seem relatively complicated; they need an elevation angle control means for changing the angle according to the rotary speed of the blades.

Therefore, there is still a need for developing flying rotor having blades with changeable elevation angle upon the change of rotary speed of the blades, but with very simple construction, in particular the elevation angle can automatically be changed upon the change of the rotary speed of the blades without any control means.

SUMMARY OF THE INVENTION

Accordingly, it is a general object of the present invention to provide a boomerang having blades that can automatically change their elevation angle and their curve radius upon the change of rotary speed of the blades thanks to a special construction of the blade shape as well as type of material of which the blades are made.

In accordance with the present invention, a boomerang of the invention launched by a hand-held launcher comprises:

a center part having a round perimeter, its bottom side provides means for attaching the upper part of hand-held launcher so that said boomerang can receive rotary movement created by said hand-held launcher, blades made of elastically plastic films, being evenly distributed about and radially extending from center part, said blades have an elevation angle $\alpha_0$ of from about 10° to about 45°, an extreme inner end having a rear groove and a front groove; and a ring having its inner perimeter mounted with extreme outer ends of said blades, said extreme outer ends have a rear groove and a front groove, wherein said blade have their curve radius longer or equal to 1/5 of radius of said ring, the ratio between the width $d_1$ of extreme outer ends and blade width is of from about 1/6 to about 6/7, the ratio between the width $d_2$ of extreme inner ends and blade width is of from about 0 to about 6/7, and the total area of said blades is of from about 10 to about 40% of the area of a circle defined by said ring.

On the flying principle, a system of blades with an elevation angle $\alpha$ moving in a medium like air will be exerted by an external force system as shown in FIG. 5*a*. The nature of the force system exerting on the moving blades is equivalent to a mechanical system as shown in FIG. 5*b*, i.e. it consists of two variable forces as drag force $F_d$ (in the direction opposite to the blade's motion) and lift force $F_l$ (in the direction opposite to the direction of gravity force). The sum of these two forces is force F perpendicular to the plane of the blades, that causes a moment $M=F\cdot d$, wherein force F is the sum of drag force $F_d$ and lift force $F_l$, d is the distance between spin center O and the position of the force F. When the speed of the blades is unchanged, the two variable forces $F_d$ and $F_l$ are in direct proportion to the elevation angle $\alpha$. When the elevation angle $\alpha$ is unchanged, then the two variable forces $F_d$ and $F_l$ shall be in direct proportion to the speed of the blades. These variations are shown FIG. 7.

If the blades are made of an elastic material, then beside the above mentioned forces, the moving blades are still exerted by elastic force $F_e$ perpendicular to the plane of the blades and in the down direction that causes elastic moment $M_e=k\cdot\beta$, wherein k is elastic coefficient of the blades, depending on the material for making blades, the size and the relative position of the two blade ends to the blade, $\beta$ is a change of elevation angle caused by moment M.

Accordingly, a boomerang having blades made of light and elastic material with a given parameter combination of initial elevation angle $\alpha_0$, elastic coefficient of blades k, size and relative position of the two ends shall be capable of self adjusting the elevation angle $\alpha$ of its blades according to the speed of its blades, that means the lift force $F_l$ and the drag force $F_d$ shall automatically be adjusted according to the change of blade speed.

Therefore, the initial elevation angle $\alpha_0$, elastic coefficient of blades k and initial curve radius of blades $r_0$ can be chosen in such way that different functions as shown in the two following models can be obtained:

Model 1: when v (blade speed) increases, then $\alpha$ decreases, blades curve radius r increases, $F_l$ and $F_d$ decrease; and on the contrary when v decreases, then $\alpha$ increases, r decreases, $F_l$ and $F_d$ increase. This creates an unexpectedly desirable effect in that the lift force is in inverse proportion to the blades speed that keeps both the boomerang not to elevate so high and its flying time prolonged.

Model 2: These parameters $\alpha_0$, k and $r_0$ can be chosen in such way that at the beginning when the speed is high, lift force will be smaller than gravity force that makes the boomerang gradually fly down; and on the contrary when the speed gradually decreases, the lift force will gradually increase and then become greater than gravity force that makes the boomerang fly up, thereby different flying orbits can be achieved.

The above said parameters can also be adjusted so that the flying time of the boomerang of the invention is maximum in order the boomerang can fly back to its departure according to the aerodynamic principle and the principle of conservation of momentum (like the principle of returning boomerang).

Therefore, although the boomerang of the present invention has very simple construction and is made of inexpensive material, it is surprised and excited by its fascinating beauty of its flying behaviors as mentioned above.

The remarkable advantage of the boomerang of the present invention is of its very simpleness in construction but easiness in adjusting the relevant parameters (the hardness of the material of which the blades are made, the width of each end of the blades, the initial elevation angle $\alpha_0$, curve radius, etc.) in order to gain the desirable effect of automatic adjustment of the elevation angle $\alpha$, resulting in automatic adjustment of lift force and drag force upon blades speed. Such an effect so far just have been achieved by only relatively complicated systems as mentioned in the Background Art part.

In order to increase the inertia weight of the boomerang of the present invention, thereby increasing the kinetic energy of the boomerang of the invention, the boomerang may be further designed in such way that its weight is distributed far from its center, for example the electric source and the light lamps such as light emitting diodes (LEDs) may be located on/inside the ring of the boomerang. Such a creative distribution of weight additionally contributes to keep the boomerang of the invention have its flying time longer than usual.

BRIEF DESCRIPTION OF THE DRAWINGS

The object and advantages mentioned above as well as the other objects and advantages of the present invention will be more clearly understood and appreciated from of the following detailed description of the preferred embodiment and by reference to the accompanying drawings below.

DETAILED DESCRIPTION OF THE PREFERRED EMBODIMENT

Figure 1:
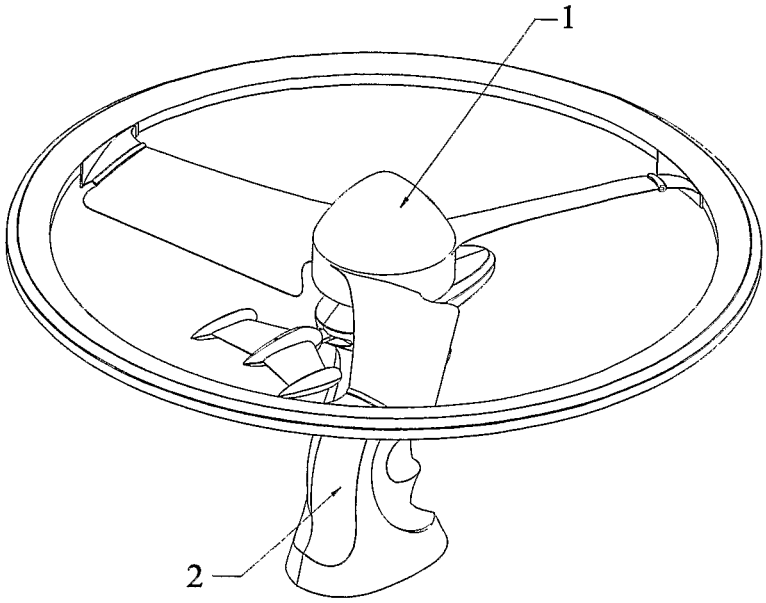
FIG. 1 is a perspective view of a boomerang of the present invention.

FIG. 1 shows a boomerang 1 according to a preferred embodiment of the present invention mounted on a hand-held launcher 2. The hand-held launcher 2 has an upper part that may be detachably fitted to a center part of the boomerang 1. The hand-held launcher 2 is capable of transferring a rotary movement to the boomerang 1. Since there is no improvement on the hand-held launcher 2, description of the handheld launcher 2 can be ignored.

Figure 2:
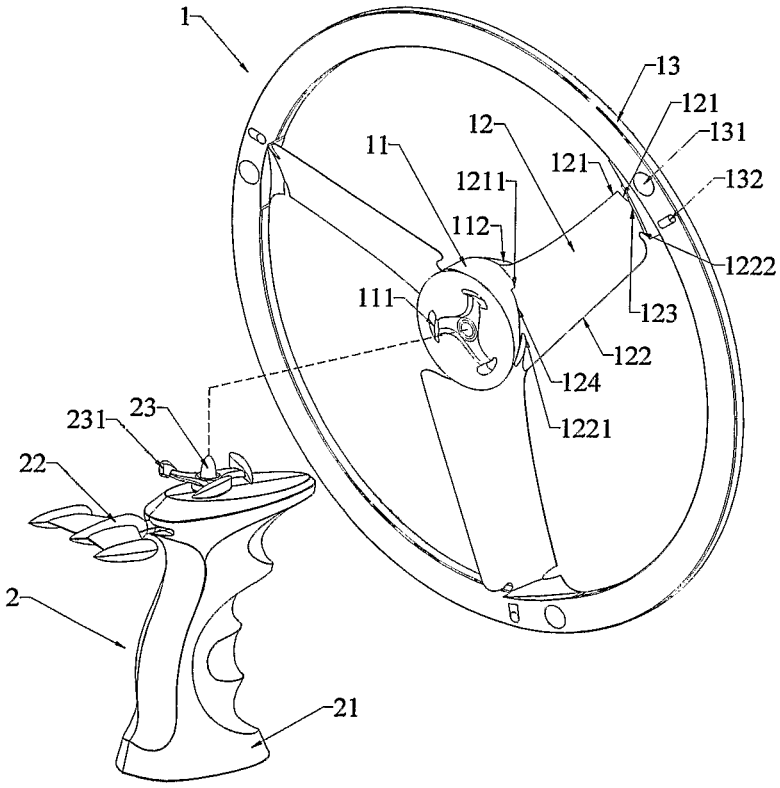
FIG. 2 is a perspective view of a boomerang of the present invention in deattaching state wherein the boomerang is deattached apart from its hand-held launcher.

The boomerang 1 comprises at least two blades 12 radially extending from the center part 11. In a preferred embodiment, the boomerang 2 comprises three blades. The blades 12 have an initial elevation angle $\alpha_0$. The initial elevation angle $\alpha_0$ preferably has a value of from about 10° to about 45°. The center part 11 is a closed part having a round perimeter, its bottom side provides a means for attaching to the upper part of the hand-held launcher 2 (see FIG. 2). The upper part of the center part 11 preferably has an aerodynamic shape, such as a round pyramid as clearly shown in FIG. 1. The boomerang 1 further has a ring 13 having its inner perimeter mounted with extreme outer ends 123 of blades 12.

Blades 12 are made of light and elastic material. For example they can be made of plastic films, such as polyvinyl chloride (PVC), polypropylene (PP), polyethylene terephthalate (PET), polystyrene (PS) or high impact polystyrene (HIPS) etc. The films preferably have a thickness of from about 0.1 mm to about 1 mm, and a specific weight of from about 0.9 g/cm$^3$ to about 1.60 g/cm$^3$.

Using such light and elastic films in the present invention is intended to create an elastic moment $M_c$ opposite to the moment M, thereby the elevation angle $\alpha$ of blades will be changed upon the change of rotary speed of blades 12.

Figure 3:
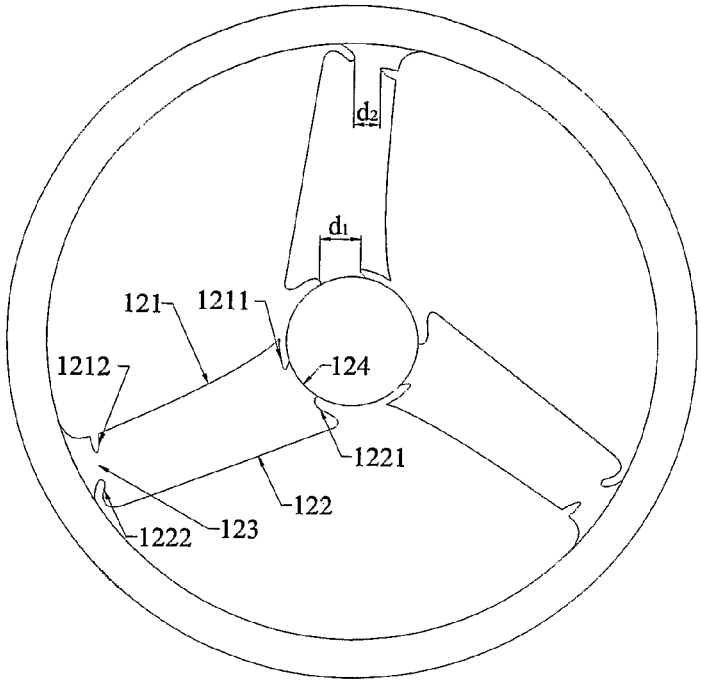
FIG. 3 is a top view of blades of a boomerang according to the present invention.
Figure 4:
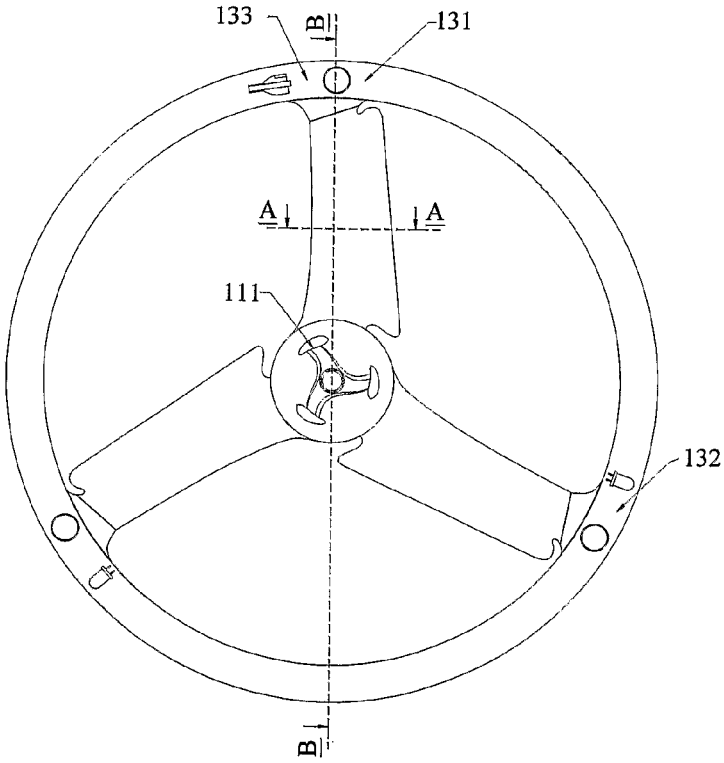
FIG. 4 is a bottom view of blades of a boomerang according to the present invention.
Figure 5A:
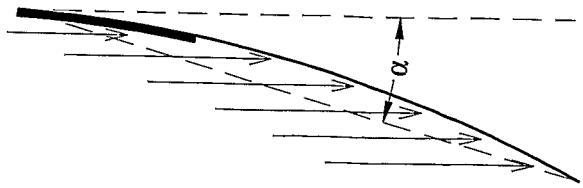
FIG. 5 is a diagram showing the external force exerting on a blade-type device when it is moving through the air (FIG. 5*a*) and a mechanical system respectively (FIG. 5*b*)
Figure 5B:
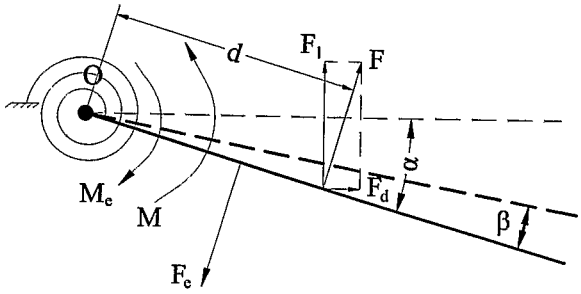
Figure 6:
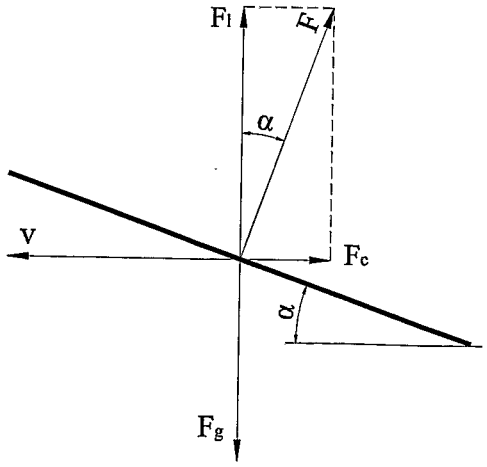
FIG. 6 is a diagram showing a system of mechanical forces exerting on a blade-type device when the device is moving through the air.
Figure 7:
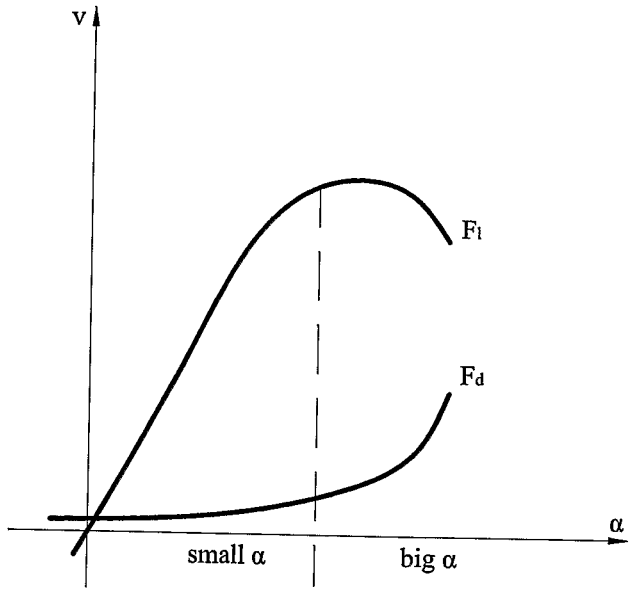
FIG. 7 is a diagram showing changes of forces exerting on a blade-type device when it is moving through the air.
Figure 8:
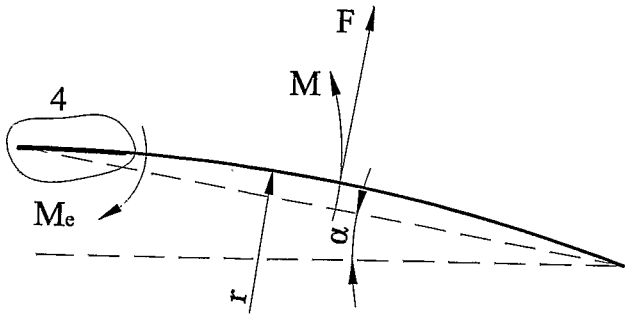
FIG. 8 is a view showing effect of a elastic force exerting on a moving blade.

As shown in FIG. 3, blades 12 of a boomerang of the present invention have rear grooves 1222 on the rear edges 122, where said extreme outer ends 123 contact with the inner perimeter of said ring 13 and rear grooves 1221 on the rear edges 122, where said extreme inner ends 124 contact with the round perimeter of said center part 11. Blades 12 may have further front grooves 1211 and 1212 on the front edges 121 as shown in FIG. 3 or without these front grooves as shown in FIG. 4. Changing the deepness of said rear grooves 1221, 1222 and said front grooves 1211, 1212 will create a change of the width $d_1$ of said extreme inner ends 124 and of the width $d_2$ of said extreme outer ends 123, resulting in a change of the relative position of said extreme outer ends 123 and said extreme inner ends 124 to each other and thereby making a change of the elevation angle $\alpha$ as well as of the curve radius r of the blades 12 upon the change of rotary speed of the blades, and thus can create desirable flying effects of said boomerang.

Having conducted very many experiments accompanied with necessary calculations, the inventor found out that with the combination: the ratio between the width $d_1$ of extreme outer ends and blade width of from about 1/7 to about 6/7 and the ratio between the width $d_2$ of extreme inner ends and blade width of from about 0 to about 6/7, boomerang of the present invention shall have flying time long enough to let it fly back to its launching position.

Figure 9:
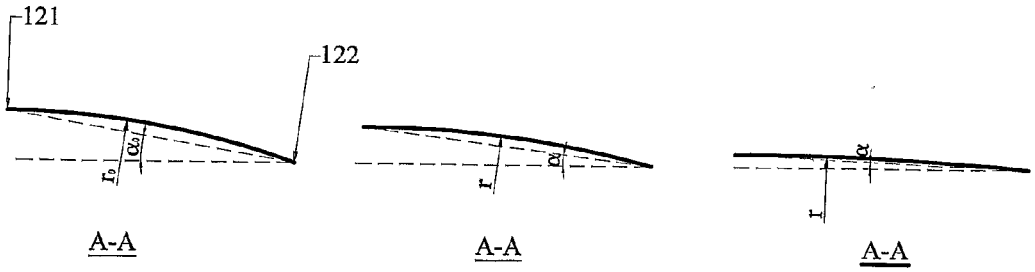
FIG. 9 is a cross-section view of blades taken along line A-A of FIG. 4 in different moving states of the blades of the present invention.
Figure 10:
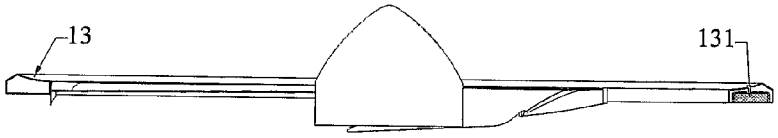
FIG. 10 is a cross-section view of the ring taken along line B-B of FIG. 4.

As shown in FIG. 9, blades 12 of a boomerang of the present invention have their initial curve radius $r_0$. In order for a boomerang of the present invention to have its flying time long enough to fly back to its launching position, the initial curve radius $r_0$ must have a value of ≥1/5 of the radius R of the ring 13. In addition, blades 12 also must have the ratio between the total area of the blades and the area of a circle defined by the ring 13 of from about 12% to about 40%, preferably of from about 12.5% to about 38%.

In use, the boomerang 1 is placed onto the upper part of the hand-held launcher 2 in such way that the end of shaft 23 and means 231, which shall rotate synchronistically with the shaft 23 when the shaft 23 rotates, on the upper part of said hand-launcher 2 are properly fitted into respective sockets 111 given in the bottom side of said boomerang 1. The user firmly holds body 21 by one hand, then uses his other hand to gasp and pull unit 22 of a pull-cord rotary movement transferer placed inside the holder 21. As a result, the shaft 23 rotates and transfers a rotary movement to the boomerang 1.

As the blade speed of the boomerang 1 increases, the force F (as sum of lift force $F_l$ and drag force $F_d$), M, and β increases, while α decreases. At the same time when M increases, the curve radius r of the blades increases (i.e. the flexure of the blades simultaneously decreases) as shown in FIG. 9. An increase of α and a decrease of r results in a decrease of F and M.

During the flying time, due to the effect of the drag force, some of the kinetic energy will be transferred into heat, causing blade speed to decrease. As a result, F, M, and β decreases, while α increases. The increase in α leads to an increase in F and M.

The above adjusting process occurs automatically so that β is always the root of the equation $M=M_e=k\cdot\beta$ throughout the flying time. As a result, the boomerang of the present invention has a longer flying time and an amusement effect that is more fascinating compared with other existing flying toys having fixed elevation angle.

While certain preferred embodiment of the present invention has been disclosed above in detail, it is to be understood by persons skilled in the art that various modifications other than the above disclosed embodiment may be adopted without departing from the spirit or the scope of the invention.

I claim:

1. A boomerang comprising:

a center part comprising at least one opening for attaching to a launcher, a plurality of blades extending radially from the center part, the inner ends of the blades coupled to the center part, wherein the blades are evenly distributed about the center part and wherein the blades comprise a front edge and a rear edge, the front edge describing a leading portion of the blades when the boomerang is in a rotational motion and the rear edge describing a trailing portion of the blades when the boomerang is in the rotational motion; and a ring, wherein the inner perimeter of the ring is mounted on the outer ends of the blades;

wherein the inner ends of the blades comprise a first groove on the rear edge of the blades and the outer ends of the blades comprise a second groove on the rear edge of the blades, the first groove spaced apart from the second groove along the rear edge of the blades, the first groove and the second groove each join the rear edge through curved zones of transition;

wherein the inner ends of the blades comprise a third groove on the front edge of the blades and the outer ends of the blades comprise a fourth groove on the front edge of the blades, the third groove spaced apart from the fourth groove along the front edge of the blades, the third groove and fourth groove each join the front edge at an intersection point;

wherein the ratio between a distance between the first groove and the third groove, and a width of the blade is from about 1/7 to 6/7;

wherein the ratio between the total area of the blades and the area of a circle defined by the ring is from about 12.5% to about 38%; and wherein each blade of the plurality of blades has a curved profile, wherein the curved profile includes a curve radius $r_0$, wherein the curve radius $r_0$ is a first value when the boomerang is stationary and a second value when the boomerang is rotating, the first value is greater than the second value.

2. The boomerang of claim 1, wherein the blades comprise a plastic film.

3. The boomerang of claim 2, wherein the plastic film has a specific weight from about 0.9 g/cm$^3$ to about 1.60 g/cm$^3$.

4. The boomerang of claim 1, wherein the blades comprise a plastic film selected from the group consisting of polyvinyl chloride, polypropylene, polyethylene terephthalate, polystyrene, and high impact polystyrene.

5. The boomerang of claim 1, wherein the blade has a thickness from about 0.1 mm to about 1 mm.

6. The boomerang of claim 1, wherein the first value of the curve radius $r_0$ of the blades is at least 1/5 of the radius of the ring.

7. The boomerang of claim 1, wherein the ratio between a total area of the blades and the area of a circle defined by the ring is from about 12% to about 40%.

8. The boomerang of claim 1, wherein the blades have an elevation angle $\alpha_0$ from about 10° to about 45°.

9. The boomerang of claim 1, wherein the blades comprise a polymer selected from the group consisting of polyvinyl chloride, polypropylene, polyethylene terephthalate, polystyrene and high impact polystyrene; wherein the specific weight of the polymer is from about 0.9 to about 1.60 g/cm$^3$; wherein the thicknesses of the blades is from about 0.1 mm to about 1 mm; wherein the ratio between a distance between the second groove and the fourth groove, and a width of the blade is from about 1/7 to about 6/7; and wherein the blades have an elevation angle $\alpha_0$ from about 10° to about 45°; wherein the curve radius $r_0$ of the blades is at least 1/5 of the radius of the ring.

10. The boomerang of claim 1 comprising two blades.

11. The boomerang of claim 1 comprising three blades.

12. The boomerang of claim 1 comprising more than three blades.

13. The boomerang of claim 1, wherein a top side of the center part has a round pyramid shape.

14. The boomerang of claim 1, wherein the ring comprises transparent or semi-transparent plastic.

15. The boomerang of claim 1, wherein the ring is hollow.

16. The boomerang of claim 1, comprising a light system, wherein the light system comprises LEDs and an electrical source having a switch that is turned on/off by centrifugal force.

17. The boomerang of claim 1, wherein an initial curve radius of the blades is at least 1/5 of the radius of the ring, the initial curve radius describing an extent of upward deflection of the blades when the boomerang is motionless, wherein the ratio between the depth of the rear groove and the width of the blade is from about 1/7 to about 6/7, and wherein the total area of the blades is from about 10% to about 40% of the area of a circle defined by the ring.

18. A boomerang comprising:

a center part comprising at least one opening for attaching to a launcher, a plurality of blades extending radially from the center part, the inner ends of the blades coupled to the center part, wherein the blades are evenly distributed about the center part, wherein the blades comprise a front edge and a rear edge, the front edge describing a leading portion of the blades when the boomerang is in a rotational motion and the rear edge describing a trailing portion of the blades when the boomerang is in the rotational motion, wherein the blades have an elevation angle $\alpha_0$ from about 10° to about 45°, wherein the blades comprise a polymer selected from the group consisting of polyvinyl chloride, polypropylene, polyethylene terephthalate, polystyrene and high impact polystyrene, wherein the specific weight of the polymer is from about 0.9 to about 1.60 g/cm$^3$; and wherein the thicknesses of the blades is from about 0.1 mm to about 1 mm; and a ring, wherein the inner perimeter of the ring is mounted on the outer ends of the blades;

wherein the inner ends of the blades comprise a first groove on the rear edge of the blades and the outer ends of the blades comprise a second groove on the rear edge of the blades, the first groove spaced apart from the second groove along the rear edge of the blades, the first groove and the second groove each join the rear edge through curved zones of transition;

wherein the inner ends of the blades comprise a third groove on the front edge of the blades and the outer ends of the blades comprise a fourth groove on the front edge of the blades, the third groove spaced apart from the fourth groove along the front edge of the blades, the third groove and the fourth groove each join the front edge at an intersection point;

wherein an initial curve radius of the blades is at least 1/5 of the radius of the ring, the initial curve radius describing an extent of upward deflection of the blades when the boomerang is motionless, the ratio between the distance between the second groove and the fourth groove, and the width of the blade is from about 1/7 to about 6/7, the ratio between a distance between the first groove and the third groove, and the width of the blade is from about 1/7 to about 6/7, and the total area of the blades is from about 12.5% to about 38% of the area of a circle defined by the ring; and wherein a spinning curve radius of the blades is less than the initial curve radius of the blades, the spinning curve radius describing an extent of upward deflection of the blades when the boomerang is spinning.

* * * * *